US010781650B2

(12) United States Patent
Herrera et al.

(10) Patent No.: US 10,781,650 B2
(45) Date of Patent: Sep. 22, 2020

(54) DOWNHOLE TOOL WITH MULTI-STAGE ANCHORING

(71) Applicant: HALLIBURTON ENERGY SERVICES, INC., Houston, TX (US)

(72) Inventors: Adan Hernandez Herrera, Humble, TX (US); Nikhil Manmadhan Kartha, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 72 days.

(21) Appl. No.: 15/325,065

(22) PCT Filed: Aug. 1, 2014

(86) PCT No.: PCT/US2014/049381

§ 371 (c)(1),
(2) Date: Jan. 9, 2017

(87) PCT Pub. No.: WO2016/018427

PCT Pub. Date: Feb. 4, 2016

(65) Prior Publication Data

US 2017/0183928 A1 Jun. 29, 2017

(51) Int. Cl.
*E21B 23/01* (2006.01)
*E21B 23/04* (2006.01)

(52) U.S. Cl.
CPC ..... *E21B 23/01* (2013.01); *E21B 23/04* (2013.01)

(58) Field of Classification Search
CPC ..... E21B 23/01; E21B 47/09
See application file for complete search history.

(56) References Cited

U.S. PATENT DOCUMENTS

| | | | |
|---|---|---|---|
| 3,705,624 | A | 12/1972 | Pitts |
| 4,575,831 | A | 3/1986 | Decorps et al. |
| 5,494,111 | A | 2/1996 | Davis et al. |
| 6,360,821 | B1 | 3/2002 | Braddick |
| 6,536,532 | B2 | 5/2003 | Doane |
| 6,935,423 | B2 | 8/2005 | Kusmer |
| 7,252,143 | B2 | 8/2007 | Sellers et al. |
| 7,789,134 | B2 | 9/2010 | Harris |

(Continued)

FOREIGN PATENT DOCUMENTS

EP 1344893 9/2003

OTHER PUBLICATIONS

"Extend" definition. From Merriam Webster. Accessible from: https://www.merriam-webster.com/dictionary/extend (Year: 2019).*

(Continued)

*Primary Examiner* — Robert E Fuller
*Assistant Examiner* — Theodore N Yao
(74) *Attorney, Agent, or Firm* — John Wustenberg; C. Tumey Law Group PLLC

(57) ABSTRACT

A downhole tool includes a tool body and an anchoring device integrated with the tool body. The anchoring device includes a contact pad that is at least partially external to the tool body, the contact pad having multiple stages with different thicknesses. The anchoring tool also includes a first linear actuator and a second linear actuator. The first linear actuator is configured to move the contact pad axially with respect to the tool body to align one of the multiple stages with the second linear actuator. The second linear actuator is configured to apply a radial force to the contact pad.

11 Claims, 4 Drawing Sheets

(56) References Cited

U.S. PATENT DOCUMENTS

| | | | | |
|---|---|---|---|---|
| 7,905,492 | B2 | 3/2011 | Doane | |
| 8,286,716 | B2 | 10/2012 | Martinez et al. | |
| 8,302,679 | B2 | 11/2012 | Mock | |
| 8,567,510 | B2 | 10/2013 | Christie et al. | |
| 2003/0188875 | A1* | 10/2003 | Bloom | E21B 4/18 166/382 |
| 2009/0159269 | A1 | 6/2009 | Sheiretov et al. | |
| 2010/0163251 | A1 | 7/2010 | Mock et al. | |
| 2011/0146970 | A1 | 6/2011 | Hallundbaek et al. | |
| 2011/0259609 | A1 | 10/2011 | Hessels et al. | |
| 2011/0277990 | A1* | 11/2011 | Kotsonis | E21B 4/18 166/217 |
| 2011/0284208 | A1 | 11/2011 | MacLeod et al. | |
| 2012/0205873 | A1 | 8/2012 | Turley | |
| 2012/0211245 | A1* | 8/2012 | Fuhst | E21B 23/04 166/382 |
| 2013/0220597 | A1 | 8/2013 | Miller | |
| 2014/0246210 | A1* | 9/2014 | Andersen | E21B 23/01 166/377 |
| 2015/0377009 | A1* | 12/2015 | Frosell | E21B 47/0905 166/382 |

OTHER PUBLICATIONS

PCT International Search Report and Written Opinion, dated May 1, 2015, Appl No. PCT/US2014/049381,"Downhole Tool with Multi-Stage Anchoring," Filed Aug. 1, 2014, 12 pgs.

PCT International Preliminary Report on Patentability, dated Mar. 30, 2016, Appl No. PCT/US/2014/049381, "Downhole Tool with Multi-Stage Anchoring," Filed Aug. 1, 2014, 14 pgs.

* cited by examiner

DOWNHOLE TOOL WITH MULTI-STAGE ANCHORING

BACKGROUND

Oil and gas exploration and production generally involve drilling boreholes, where at least some of the boreholes are converted into permanent well installations such as production wells, injections wells, or monitoring wells. Before or after a borehole has been converted into a permanent well installation, the borehole or casing may be modified to update its purpose and/or to improve its performance. Such borehole or casing modifications are sometimes referred to as well interventions. Some examples of well interventions involve using a coiled tubing or wireline to deploy one or more tools for matrix and fracture stimulation, wellbore cleanout, logging, perforating, completion, casing, workover, nitrogen kickoff, sand control, drilling, cementing, well circulation, fishing services, sidetrack services, mechanical isolation, and/or plugging. Other examples of well interventions involve using a slickline to deploy a tool for completion, workover, and production intervention services.

Sometimes the tool performing a well intervention needs to be anchored against a borehole wall or a tubular (e.g., a casing). Existing anchors designs may suffer from one or more of the following shortcomings: a limited reach, insufficient anchoring force or grip, a large profile, lack of durability, and power loss/sticking issues.

BRIEF DESCRIPTION OF THE DRAWINGS

Accordingly, there are disclosed in the drawings and the following description a downhole tool with multi-stage anchoring intended to address the at least some of the above-mentioned shortcomings. In the drawings.

Figure 1:
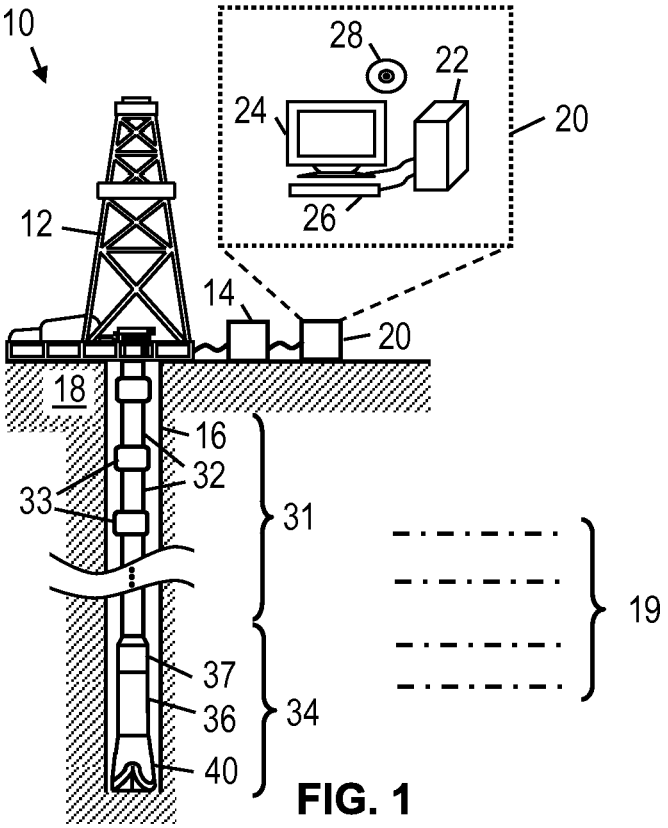
FIG. 1 is schematic diagram showing a drilling environment.

It should be understood, however, that the specific embodiments given in the drawings and detailed description do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein is a multi-stage anchoring design to provide an adjustable anchoring reach on, for example, a downhole tool. The anchoring design may be replicated as needed to provide a plurality of adjustable anchoring contact points. As an example, a downhole tool may comprise a tool body and an anchoring device. In accordance with at least some embodiments, the anchoring device is integrated with the tool body such that when the anchoring device contacts a surface (e.g., a borehole wall or tubular), the downhole tool is anchored. Such integration of the anchoring device with the tool body may include positioning at least some components of the anchoring device within the tool body to apply a radial or outward force to a contact pad (e.g., a slip) that is positioned external to the tool body. Further, such integration of the anchoring device with the tool body may include shaping or machining the tool body for use with anchoring device components. Further, such integration of the anchoring device with the tool body may include at least some components of the anchoring device being bolted, strapped, or otherwise attached to the tool body. In at least some embodiments, the anchoring device includes a contact pad positioned along the outside of the tool body, the contact pad having multiple stages with different thicknesses. The anchoring device also includes a first linear actuator and a second linear actuator. Each linear actuator corresponds to a hydraulic or electromechanical device (e.g., a motor-based actuator) with a movable element (e.g., a piston, rod, etc.). The first linear actuator is configured to move the contact pad axially with respect to the tool body to align one of the multiple stages with the second linear actuator. In other words, the first linear actuator operates to adjust the reach of the anchoring device by aligning different contact pad stages with the second linear actuator and/or with a platform associated with the second linear actuator. To move the contact pad axially forward (e.g., to align a contact pad stage with increased thickness with the second linear actuator), the first linear actuator applies a force with at least some forward axial component to its moveable component. Meanwhile, to move the contact pad axially backwards (e.g., to align a contact pad stage with decreased thickness with the second linear actuator), the first linear actuator applies a force with at least some backwards axial component to its moveable component. In some embodiments, moving the contact pad axially backwards is the result of the first linear actuator not applying any force to its moveable component and/or triggering a contact pad position release mechanism. Thus, when anchoring is complete and/or should the downhole tool lose power, the contact pad may move axially to a default axial position that minimizes an anchoring device profile. Such movement of the contact pad to a default axial position can be controlled by the first linear actuator, a tension (spring) mechanism, and/or a slip position release mechanism.

Once a suitable contact pad stage is aligned with the second linear actuator (i.e., once a suitable preliminary anchoring device reach has been achieved), the second linear actuator is configured to apply a radial force to the contact pad to increase a reach and/or grip of the anchoring device. More specifically, to move the contact pad radially outward, the second linear actuator applies a force with at least some outward radial component to its moveable component. Meanwhile, to move the contact pad radially inward, the second linear actuator applies a force with at least some radially inward component to the moveable component. In some embodiments, moving the contact pad radially inward is the result of the second linear actuator not applying any force to its moveable component and/or triggering a contact pad tension release mechanism. Thus, when anchoring is complete and/or should the downhole tool lose power, the contact pad may move radially to a default radial position that minimizes an anchoring device profile. Such movement of the contact pad to a default radial position can be controlled by the second linear actuator, a tension (spring) mechanism, and/or a contact pad position release mechanism. It should be noted that contact pad may have a default axial position as well as a default radial position. Such default positions may be configured before the downhole tool is deployed based on expected clearance space in a borehole or tubular. As needed, the default positions can be updated to facilitate conveyance and expedited deployment of the multi-stage anchoring device.

The disclosed anchoring device designs may be used with various types of downhole tools. In particular, downhole tools configured to perform well intervention operations may employ the disclosed anchoring device. For example, an anchored downhole tool may perform one or more well intervention operations including, but not limited to, matrix and fracture stimulation, wellbore cleanout, logging, perforating, completion, casing, production intervention, workover, nitrogen kickoff, sand control, drilling, cementing, well circulation, fishing services, sidetrack services, mechanical isolation, and/or plugging. Depending on the downhole operations to be performed, the anchoring specifications for each downhole tool (e.g., the number of anchoring devices used, the orientation and position of each anchoring device along a tool body, the amount of force to be applied by each linear actuator, etc.) may be adjusted. The anchoring specifications may also be adjusted depending on the size of tool body relative to a borehole or tubular size.

The disclosed anchoring device designs are best understood when described in an illustrative usage context. FIG. 1 shows an illustrative drilling environment 10, where a drilling assembly 12 enables a drill string 31 to be lowered and raised in a borehole 16 that penetrates formations 19 of the earth 18. The drill string 31 is formed, for example, from a modular set of drill pipe sections 32 and adaptors 33. At the lower end of the drill string 31, a bottomhole assembly 34 with a drill bit 40 removes material from the formation 18 using known drilling techniques. The bottomhole assembly 34 also includes one or more drill collars 37 and may include a logging tool 36 to collect measure-while-drilling (MWD) and/or logging-while-drilling (LWD) measurements.

In FIG. 1, an interface 14 at earth's surface receives the MWD and/or LWD measurements via mud-based telemetry or other wireless communication techniques (e.g., electromagnetic, acoustic). Additionally or alternatively, a cable (not shown) including electrical conductors and/or optical waveguides (e.g., fibers) may be used to enable transfer of power and/or communications between the bottomhole assembly 34 and the earth's surface. Such cables may be integrated with, attached to, or inside components of the drill string 31 (e.g., IntelliPipe sections may be used).

The interface 14 may perform various operations such as converting signals from one format to another, filtering, demodulation, digitization, and/or other operations. Further, the interface 14 conveys the MWD and/or LWD measurements or related data to a computer system 20 for storage, visualization, and/or analysis. In at least some embodiments, the computer system 20 includes a processing unit 22 that enables visualization and/or analysis of MWD and/or LWD measurements by executing software or instructions obtained from a local or remote non-transitory computer-readable medium 28. The computer system 20 also may include input device(s) 26 (e.g., a keyboard, mouse, touchpad, etc.) and output device(s) 24 (e.g., a monitor, printer, etc.). Such input device(s) 26 and/or output device(s) 24 provide a user interface that enables an operator to interact with the logging tool 36 and/or software executed by the processing unit 22. For example, the computer system 20 may enable an operator to select visualization and analysis options, to adjust drilling options, and/or to perform other tasks. Further, the MWD and/or LWD measurements collected during drilling operations may facilitate determining the location of subsequent well intervention operations and/or other downhole operations, where the downhole tool is anchored as described herein.

Figure 2A:
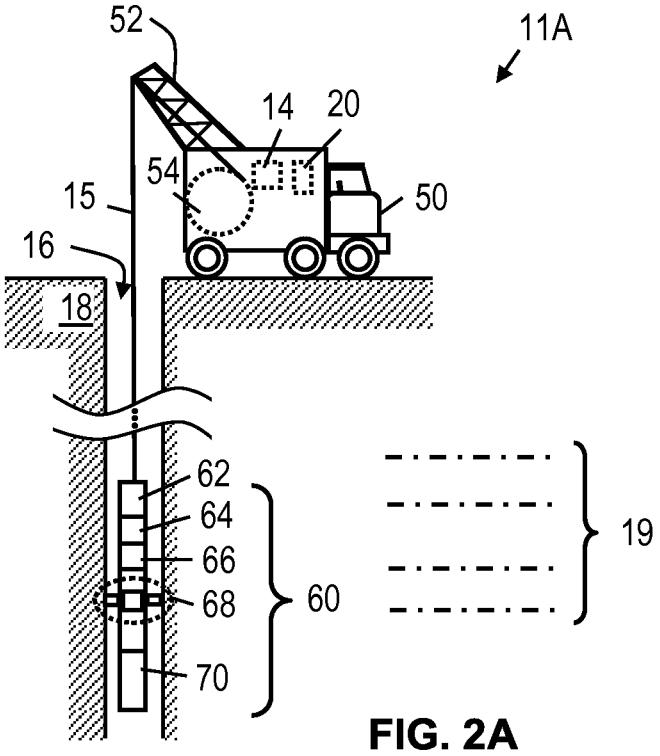
FIGS. 2A and 2B are schematic diagrams showing wireline tool string environments.

At various times during the drilling process, the drill string 31 shown in FIG. 1 may be removed from the borehole 16. With the drill string 31 removed, wireline logging and/or well intervention operations may be performed as shown in the wireline tool string environment 11A of FIG. 2A (an "openhole" scenario). In environment 11A, a wireline tool string 60 is suspended in borehole 16 that penetrates formations 19 of the earth 18. For example, the wireline tool string 60 may be suspended by a cable 15 having electrical conductors and/or optical fibers for conveying power to the wireline tool string 60. The cable 15 may also be used as a communication interface for uphole and/or downhole communications. In at least some embodiments, the cable 15 wraps and unwraps as needed around cable reel 54 when lowering or raising the wireline tool string 60. As shown, the cable reel 54 may be part of a movable logging facility or vehicle 50 having a cable guide 52.

In at least some embodiments, the wireline tool string 60 includes various sections including a power section 62, control/electronics section 64, actuator section 66, anchor section 68, and intervention tool section 70. The anchor section 68, for example, includes one or more anchor devices as described herein to contact the wall of borehole 16, thereby maintaining the wireline tool string 60 in a fixed position during intervention tool operations and/or other operations. While not required, the wireline tool string 60 may also include one or more logging tool sections to collect sensor-based logs as a function of tool depth, tool orientation, etc.

At the earth's surface, an interface 14 receives sensor-based measurements and/or communications from wireline tool string 60 via the cable 15, and conveys the sensor-based measurements and/or communications to computer system 20. The interface 14 and/or computer system 20 (e.g., part of the movable logging facility or vehicle 50) may perform various operations such as data visualization and analysis, anchoring device control, intervention tool monitoring and control, and/or other operations.

Figure 2B:
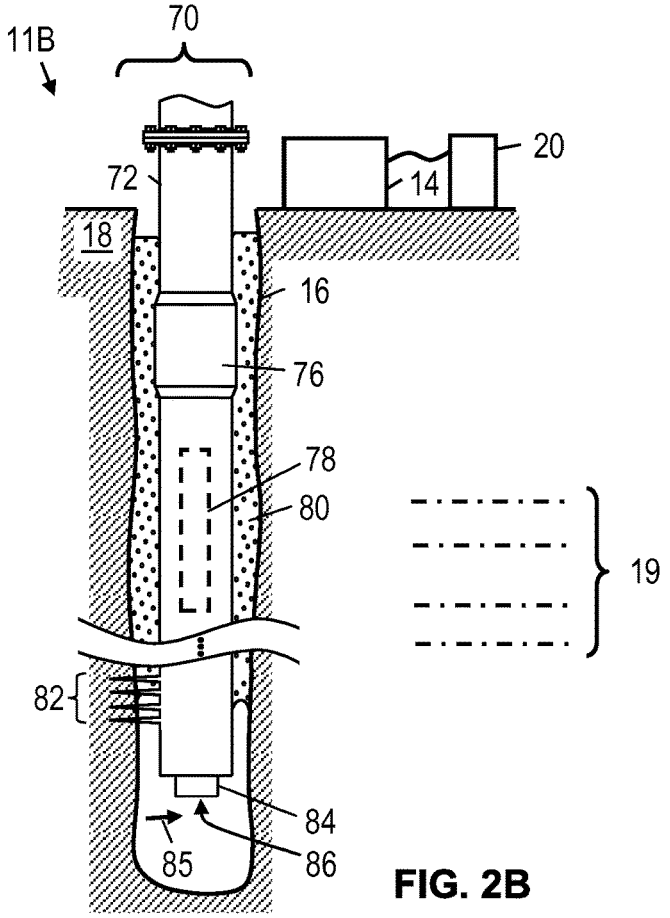

FIG. 2B shows another wireline tool string environment 11B (a "completed well" or at partially completed well scenario). In environment 11B, a drilling rig has been used to drill borehole 16 that penetrates formations 19 of the earth 18 in a typical manner (see FIG. 1A). Further, a casing string 72 is positioned in the borehole 16. The casing string 72 of well 70 includes multiple tubular casing sections (usually about 30 feet long) connected end-to-end by couplings 76. It should be noted that FIG. 2B is not to scale, and that casing string 72 typically includes many such couplings 76. Further, the well 70 includes cement slurry 80 that has been injected into the annular space between the outer surface of the casing string 72 and the inner surface of the borehole 16 and allowed to set. Further, a production tubing string 84 has been positioned in the inner bore of the casing string 72.

In at least some embodiments, the purpose of the well 70 is to guide a desired fluid (e.g., oil or gas) from a section of the borehole 16 to a surface of the earth 18. In such case, perforations 82 may be formed at a section of the borehole 16 to facilitate the flow of a fluid 85 from a surrounding formation 19 into the borehole 16 and thence to earth's surface via an opening 86 at the bottom of the production tubing string 84. Note that this well configuration is illustrative and not limiting on the scope of the disclosure. Other permanent well configurations may be configured as injection wells or monitoring wells.

In environment 11B, a wireline tool string 78 may be deployed inside casing string 72 (e.g., before the production tubing string 84 has been positioned in an inner bore of the casing string 72) and/or production tubing string 84. In accordance with at least some embodiments, the wireline tool string 78 has sections similar to those described for wireline tool string 60, but may have a different outer diameter to facilitate deployment in a tubular rather than an openhole scenario. In particular, the wireline tool string 78 includes one or more anchoring devices as described herein to contact the inner bore of casing string 72 or production tubing string 84, thereby maintaining the wireline tool string 78 in a fixed position during intervention tool operations and/or other operations. While not required, the wireline tool string 78 may include one or more logging tool sections to collect sensor-based logs as a function of tool depth, tool orientation, etc.

At earth's surface, a surface interface 14 receives sensor-based measurements and/or communications from wireline tool string 78 via a cable or other telemetry, and conveys the sensor-based measurements and/or communications to computer system 20. The surface interface 14 and/or computer system 20 may perform various operations such as data visualization and analysis, anchoring device control, intervention tool monitoring and control, and/or other operations. While FIGS. 2A and 2B describe deployment of downhole tools using a wireline, it should be appreciated that coiled tubing is another option for such deployment.

Figure 3A:
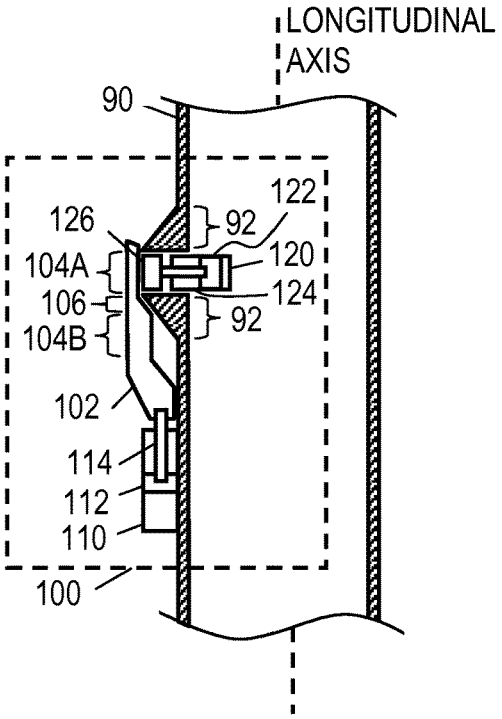
FIGS. 3A-3D are a cross-sectional views showing part of a downhole tool with a multi-stage anchoring device.
Figure 3B:
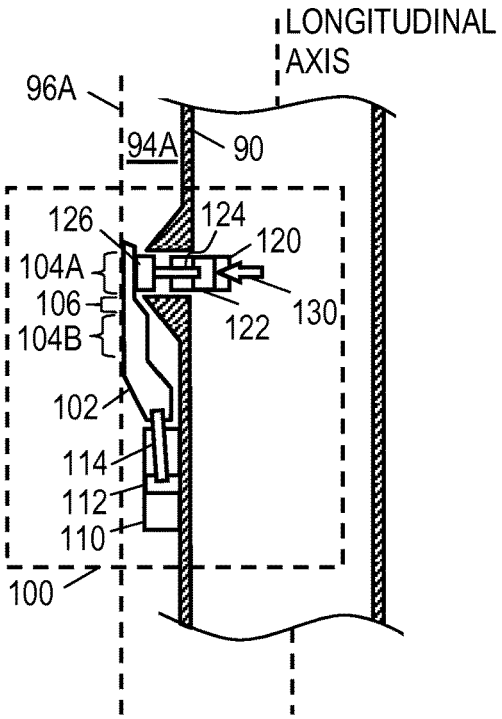
Figure 3C:
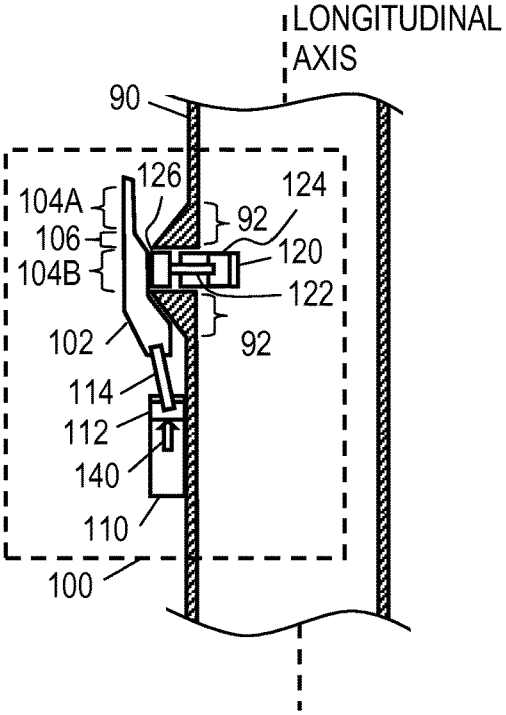
Figure 3D:
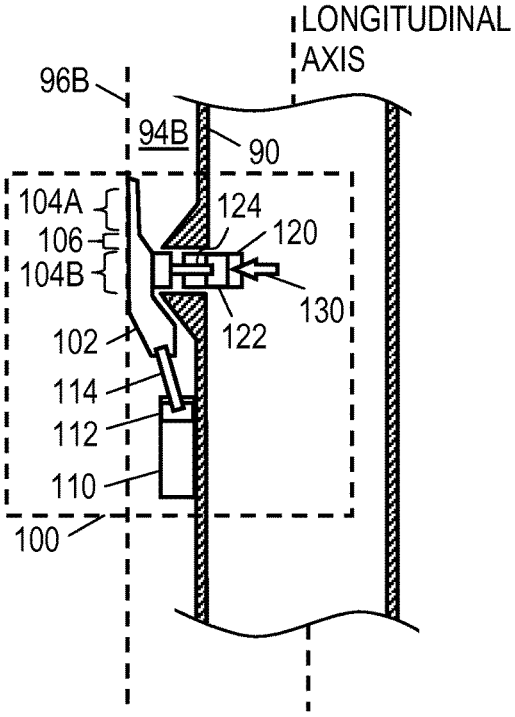

FIGS. 3A-3D show part of a downhole tool (e.g., tools 60 or 78) with an anchoring device 100. The anchoring device 100 may, for example, be part of the anchor section 66 mentioned for wireline tool string 60. More specifically, FIGS. 3A and 3B show the anchoring device 100 with a multi-stage contact pad 102 in a default position, said contact pad 102 alternatively having a curved outer surface with a radius to approximately correspond to the radius of the curved inner surface of the borehole 16; or a flat surface as shown in FIGS. 4A-4C, 5A-5C, and 6A-6C. FIGS. 3C and 3D show the anchoring device 100 with multi-stage contact pad 102 in an extended reach position. For the embodiment of FIGS. 3A-3D, multi-stage contact pad 102 has two stages 104A and 104B separated by sloped section 106, where stages 104A and 104B have different thicknesses to enable an adjustable anchoring reach.

In FIGS. 3A and 3B, stage 104A of the multi-stage contact pad 102 is aligned with a contact component 126 associated with linear actuator 120. The position of the contact pad 102 in FIGS. 3A and 3B corresponds to a default position, where the thinnest stage of multi-stage contact pad 102 is aligned with contact component 126. In alternative embodiments, the default position for multi-stage contact pad 102 may be any predetermined stage rather than the thinnest stage. Further, the default position for multi-stage contact pad 102 could be such that none of its stages are aligned with contact component 126. In such case, the contact component 126 associated with linear actuator 120 could be used to contact a surface (e.g., a borehole wall or tubular) directly. However, if the anchoring reach needs to be extended, the multi-stage contact pad 102 could be moved axially to align one of its stages with the contact component 126.

In FIGS. 3A-3D, the multi-stage contact pad 102 is connected to moving element 112 of linear actuator 110 to enable axial movement of the multi-stage contact pad 102. As described herein, such axial movement enables different stages of the multi-stage contact pad 102 to be aligned with contact component 126. In at least some embodiments, the multi-stage contact pad 102 connects to moving element 112 via coupler 114, which may correspond to a spring. Additionally or alternatively, the coupler 114 may correspond to a rod or beam. Further, the coupler 114 may be rotatably coupled to each of the multi-stage contact pads 102 and the moving element 112 (e.g., via pins). Regardless of the particular coupling used between linear actuator 110 and multi-stage contact pad 102, it should be appreciated that the amount of force needed to axially move multi-stage contact pad 102 may be small. Thus, the size of linear actuator 110 and related actuation components may likewise be small. Regardless of size, the linear actuator 110 may attach to tool body 90 via straps, bolts, or other fasteners. Further, it should be appreciated that the position and reach of the linear actuator 110 may vary. The reach for linear actuator 110 is based on the size of multi-stage contact pad 102 (i.e., the size of each stage and the number of stages). Regardless of its reach, the position of linear actuator 110 can be varied by adjusting the length of coupler 114. Further, while the linear actuator 110 is shown to be entirely external to the tool body 90 in FIGS. 3A-3D, other variations are possible. For example, in some embodiments, at least part of linear actuator 110 may be internal to and/or integrated with the tool body 90. Further, the angle of the linear actuator 110 may vary. Any positioning or angle for linear actuator 110 is possible as long as movement of its moving element 112 can be converted to axial movement of the multi-stage contact pad 102.

In FIGS. 3A and 3B, stage 104A of multi-stage contact pad 102 is aligned with the contact component 126 associated with linear actuator 120. If stage 104A provides a suitable anchoring reach for anchoring device 100, the linear actuator 120 may apply a radial force 130 to moving element 122 as shown in FIG. 3B. The determination of whether the anchoring reach associated with a particular stage is suitable depends on the clearance space 94A between tool body 90 and surface 96A (e.g., a borehole wall or tubular), and the reach of linear actuator 120. In FIG. 3B, at least part of the radial force 130 applied to moving element 122 is applied to contact component 126 (e.g., through coupler 124) and stage 104A. The result of applying the radial force 130 is that the anchoring device 100 anchors a downhole tool associated with tool body 90 against surface 96A. While the linear actuator 120 is shown to be entirely internal to the tool body 90 in FIGS. 3A-3D, other variations are possible. For example, in some embodiments, at least part of linear actuator 120 may be external to and/or integrated with the tool body 90. Further, the angle of the linear actuator 120 may vary. Any positioning or angle for linear actuator 120 is possible as long as movement of its moving element 122 can be converted to radial movement of the multi-stage contact pad 102.

The amount of radial force 130 provided by linear actuator 120 may vary depending on the type of downhole operations to be performed while a downhole tool related with tool body 90 is anchored. Without limitation, some embodiments of linear actuator 120 may provide a radial force up to and exceeding 5000 psi to moving element 122. If hydraulic actuation is used for linear actuator 120, a predetermined ratio of diameters between a hydraulic feedline and a piston chamber associated with linear actuator 120 enables a suitable amount of force to be achieved. As an example (without limitation to other embodiments) one embodiment uses a hydraulic feedline with a 0.25 inch diameter and a piston chamber with a 1.0 inch diameter to be used in conjunction with linear actuator 120.

In accordance with at least some embodiments, the reach of linear actuator 120 is preferably small to facilitate integrating the linear actuator 120 within tool body 90. For example, in downhole tool embodiments that employ multiple anchoring devices 100 together at the same longitudinal position along a tool body 90, the reach would be limited such that the linear actuator 120 does not occupy more than about half of the width of the tool body's interior space. Of course, if anchoring devices 100 are longitudinally offset from each along the tool body 90, the position of the linear actuator 120 within tool body 90 and its reach could vary.

Further, the tool body 90 may include a raised portion 92 for use with the anchoring device 100. More specifically, the raised portion 92 extends the outer profile of the tool body 90 to ensure anchoring reach and packaging criteria for linear actuator 120 are met. The raised portion 92 also may facilitate sealing the interior of tool body 90. For example, one or more seals may be positioned between contact component 126 and the raised portion 92, and/or between linear actuator 120 and the raised portion 92. It should be appreciated that in different embodiments, the dimensions of raised portion 92 (e.g., its outward profile and slope) may vary. Regardless of its particular dimensions, the raised portion 92 may be part an integral tool body 90, or may correspond to a separate component that is attached to tool body 90.

In FIG. 3C, the linear actuator 110 applies an axial force 140 to moving element 112 to move the multi-stage contact pad 102 axially. Again, the multi-stage contact pad 102 and the moving element 112 may be connected via coupler 114. More specifically, application of the axial force 140 by the linear actuator 110 causes stage 104B of the multi-stage contact pad 102 to be aligned with the contact component 126 associated with linear actuator 120 instead of stage 104A. In accordance with at least some embodiments, transitions between stages 104A and 104B are facilitated using sloped section 106. More specifically, when stage 104A is aligned with contact component 126, the sloped section 106 contacts or is close to raised portion 92 of tool body 90. Thus, when axial force 140 is applied, the sloped section 106 contacts the raised portion 92 such that the transition between stages 104A and 104B does not involve sharp edges or corners that are susceptible to being snagged. For a multi-stage contact pad with additional stages (3 or more stages), additional sloped sections could be used to facilitate the transition between each stage as needed. Further, in at least some embodiments, slope sections such as section 106 may also serve to provide a detectable end to each stage. Thus, the amount of axial movement provided by linear actuator 110 may be preprogrammed using known stage sizes and/or may involve detecting that a particular stage is aligned using sensors or feedback.

Once stage 104B of the multi-stage contact pad 102 is aligned with contact component 126, the radial force 130 is applied to moving element 122, contact component 126 (e.g., through coupler 124), and stage 104B. The result of applying the radial force 130 is that the anchoring device 100 anchors a downhole tool associated with tool body 90 against surface 96B. Again, the amount of radial force 130 provided by linear actuator 120 may vary depending on the type of downhole operations to be performed while a downhole tool related with tool body 90 is anchored. Compared to using stage 104A for anchoring, stage 104B provides an extended anchoring reach suitable for a clearance space 94B between tool body 90 and surface 96B (e.g., a borehole wall or tubular) that is larger than the clearance space 94A between tool body 90 and surface 96A represented in FIG. 3B.

Figure 4A:
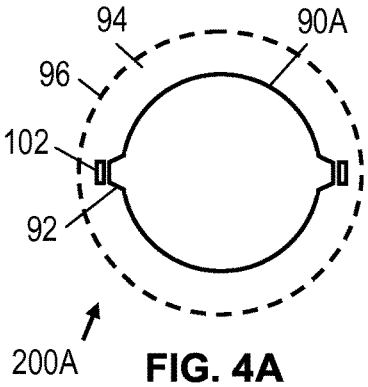
FIGS. 4A-4C are simplified views showing default anchoring device configurations.
Figure 4B:
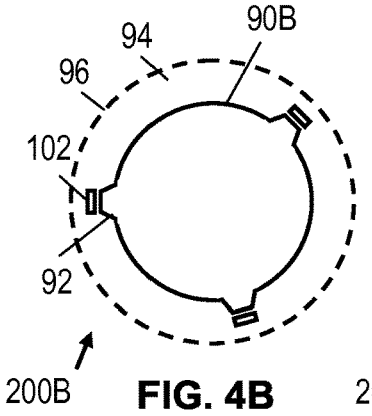
Figure 4C:
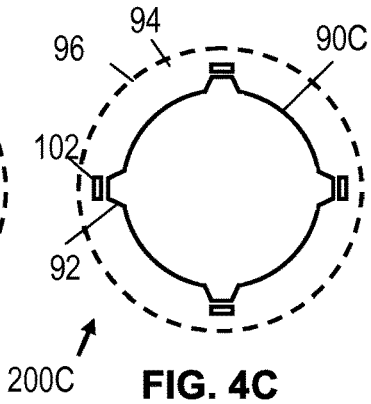

FIGS. 4A-4C show various default anchoring device configurations 200A-200C. In default anchoring device configuration 200A, two multi-stage contact pads 102 are used with a tool body 90A having two raised portions 92. In default anchoring device configuration 200B, three multi-stage contact pads 102 are used with a tool body 90B having three raised portions 92. In default anchoring device configuration 200C, four multi-stage contact pads 102 are used with a tool body 90C having four raised portions 92. In each of the default anchoring device configurations 200A-200C, each of the multi-stage contact pads 102 represented are associated with an anchoring device such as anchoring device 100. For each of the default anchoring device configurations 200A-200C, the outer profile of the multi-stage contact pads 102 and related anchoring device components is minimized. As previously discussed, an alternative default anchoring configuration may correspond to any predetermined stages of multi-stage contact pads 102 being used. Alternatively, the default axial position for the multi-stage contact pads 102 may be such that no stage is aligned with the raised portions 92. In such case, the outer profile of the raised portions 92 may be larger than the outer profile of the multi-stage contact pads 102 in their default position. In at least some embodiments, the default anchoring device configurations 200A-200C correspond to axial positions for the multi-stage contact pad 102, where the clearance space 94 between the multi-stage contact pads 102 and surface 96 is maximized to facilitate positioning the downhole tool in a borehole or tubular.

Figure 5A:
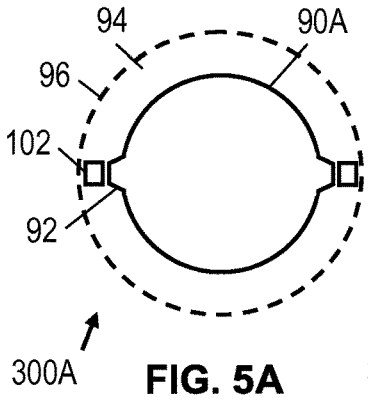
FIGS. 5A-5C are simplified views showing extended reach anchoring device configurations.
Figure 5B:
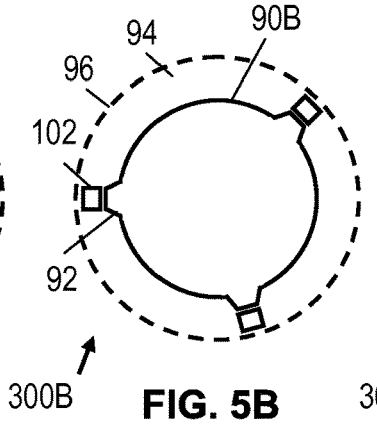
Figure 5C:
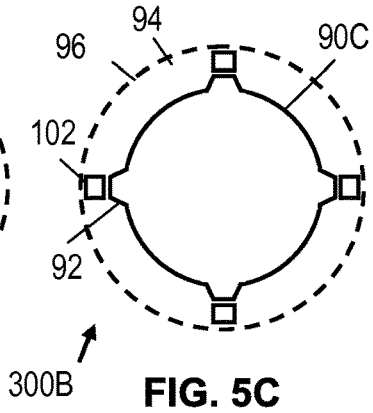

FIGS. 5A-5C show various extended anchoring device configurations 300A-300C. In extended anchoring device configuration 300A, the two multi-stage contact pads 102 mentioned for default anchoring device configuration 200A have been moved axially to align thicker stages with the two raised portions 92. In extended anchoring device configuration 300B, the three multi-stage contact pads 102 mentioned for default anchoring device configuration 200B have been moved axially to align thicker stages with the three raised portions 92. In extended anchoring device configuration 300C, the four multi-stage contact pads 102 mentioned for default anchoring device configuration 200C have been moved axially to align thicker stages with the four raised portions 92. In at least some embodiments, the extended anchoring device configurations 300A-300C correspond to axial positions for the multi-stage contact pads 102, where the clearance space 94 between the multi-stage contact pads 102 and surface 96 is minimized to facilitate anchoring the downhole tool in a borehole or tubular. However, it should be appreciated that minimizing the amount of clearance space 94 between each multi-stage contact pad 102 and surface 96 does not anchor the downhole tool corresponding to tool bodies 90A-90C.

Figures 6A, 6B, 6C:
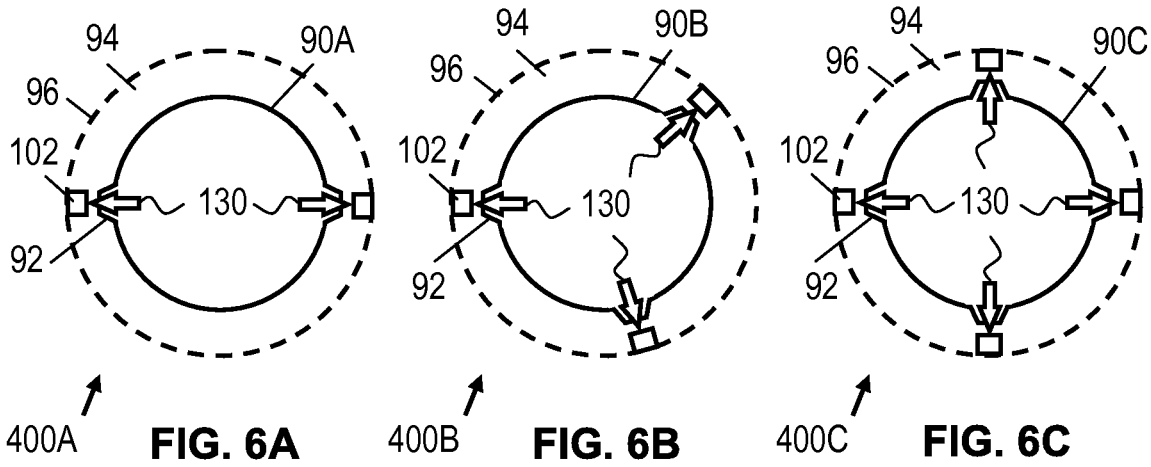
FIGS. 6A-6C are simplified views showing set anchoring device configurations.

FIGS. 6A-6C show various set anchoring device configurations 400A-400C. In set anchoring device configuration 400A, a radial force 130 is applied to the two multi-stage contact pads 102 mentioned for extended anchoring device configuration 300A. When applied, the radial force 130 anchors a downhole tool corresponding to tool body 90A by pushing the two multi-stage contact pads 102 against surface 96. Application of the radial force 130 to the extended reach anchoring device configuration 300A results in suitably strong two-sided anchoring even if the reach of radial force 130 is small.

In set anchoring device configuration 400B, a radial force 130 is applied to the three multi-stage contact pads 102 mentioned for extended anchoring device configuration 300B. When applied, the radial force 130 anchors a downhole tool corresponding to tool body 90B by pushing the three multi-stage contact pads 102 against surface 96. Application of the radial force 130 to the extended reach anchoring device configuration 300B results in suitably strong three-sided anchoring even if the reach of radial force 130 is small.

In set anchoring device configuration 400C, a radial force 130 is applied to the four multi-stage contact pads 102 mentioned for extended anchoring device configuration 300C. When applied, the radial force 130 anchors a downhole tool corresponding to tool body 90C by pushing the four multi-stage contact pads 102 against surface 96. Application of the radial force 130 to the extended reach anchoring device configuration 300C results in suitably strong four-sided anchoring even if the reach of radial force 130 is small.

While FIGS. 4A-4C, 5A-5C, and 6A-6C show anchoring device configurations, where axial and radial movement of multi-stage contact pads 102 occur together, it should be appreciated that individual multi-stage contact pads 102 can be axially or radially moved as needed. Further, each of the configurations 200A-200C, 300A-300C, and 400A-400C of FIGS. 4A-4C, 5A-5C, and 6A-6C represents only one "layer" of anchoring. In practice, a downhole tool (e.g., tool 60 or 78) may have multiple layers of anchor units. For example, multiple anchoring devices 100 may be positioned along a downhole tool. The number of anchoring devices 100 for each layer may vary as noted herein. Further, the orientation of anchoring devices 100 for each layer may vary such that the contact point options vary with respect to azimuth (increasing stability of the anchor and providing selectable anchor options). Finally, other embodiments are possible as well including anchoring device configurations using five or more contact pads 102.

Figure 7:
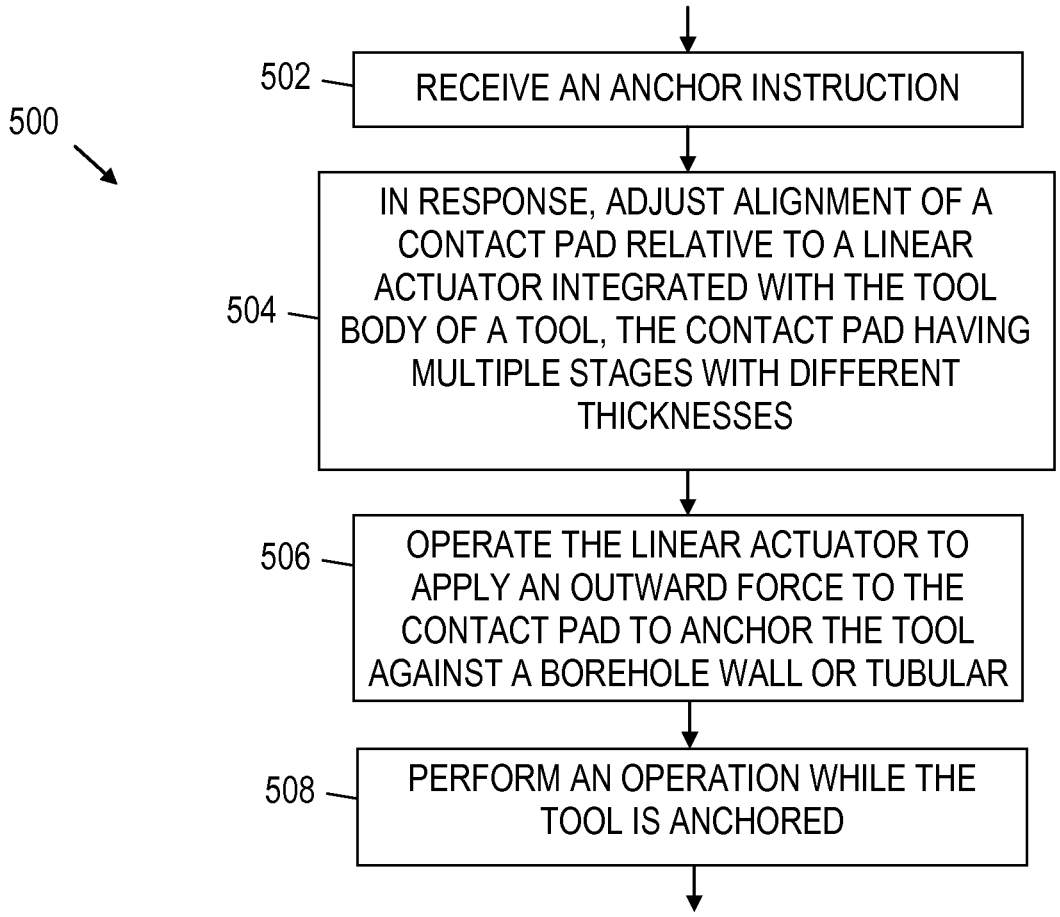
FIG. 7 is a flowchart showing a well intervention method.

FIG. 7 shows a well intervention method 500. The method 500 may be performed, for example, by a downhole tool (e.g., part of wireline tool string 60 or 78). At block 502, an anchor instruction is received. The anchor instruction may be received (e.g., by wireline tool string 60 or 78) from a surface computer (e.g., computer 70) with programming and/or an operator that selects when the downhole tool is to be anchored. Additionally or alternatively, the downhole tool may receive the anchor instruction from an embedded processing system (e.g., part of control/electronics section 64 of wireline tool string 60) that determines when the downhole tool is to be anchored using sensor-based data collected downhole. In at least some embodiments, the anchor instruction initiates a multi-stage contact pad procedure, where a multi-stage contact pad is first moved axially (e.g., using linear actuator 110) to align a particular stage with a linear actuator (e.g., linear actuator 120) at block 504. After alignment, the multi-stage contact pad procedure operates the linear actuator (e.g., linear actuator 120) to apply a radial force to the multi-stage contact pad to anchor a corresponding downhole tool at block 506. At block 508, an operation is performed with the downhole tool is anchored. Example operations include, but are not limited to, setting or removing a plug (e.g., for hydraulic fracturing operations), shifting a sleeve (e.g., a filter or screening sleeve), and cutting or milling a damaged tubular.

Embodiments Disclosed Herein Include:

A: A downhole tool that comprises a tool body and an anchoring device integrated with the tool body. The anchoring device comprises a contact pad that is at least partially external to the tool body, the contact pad having multiple stages with different thicknesses. The anchoring device also includes a first linear actuator and a second linear actuator. The first linear actuator is configured to move the contact pad axially with respect to the tool body to align one of the multiple stages with the second linear actuator. The second linear actuator is configured to apply a radial force to the contact pad.

B: A method that comprises receiving, by a tool deployed in a downhole environment, an anchor instruction. The method also comprises, in response to receiving the anchor instruction, adjusting alignment of a contact pad relative to a linear actuator integrated with a tool body of the tool, wherein the contact pad has multiple stages with different thicknesses. The method also comprises operating the linear actuator to apply an outward force to the contact pad to anchor the tool against a borehole wall or tubular. The method also comprises performing an operation while the tool is anchored.

Each of the embodiments, A and B, may have one or more of the following additional elements in any combination. Element 1: the contact pad has an inclined surface between adjacent stages. Element 2: the anchoring device further comprises a shaft coupling the first linear actuator with the contact pad. Element 3: the shaft is rotatably-coupled at opposite ends to the first linear actuator and the contact pad. Element 4: the anchoring device further comprises a spring between the shaft and the first linear actuator. Element 5: the tool body comprises a raised portion, and wherein the contact pad passes over the raised portion when changing which of the multiple stages is aligned with the second linear actuator. Element 6: the second linear actuator comprises a hydraulic actuator. Element 7: the hydraulic actuator has a hydraulic feedline and piston chamber with a predetermined diameter relationship. Element 8: further comprising a well intervention component that is activated after the anchoring device anchors the tool against a borehole wall or tubular. Element 9: further comprising a plurality of said anchoring device to anchor the tool at different longitudinal or azimuthal positions against a borehole wall or tubular. Element 10: further comprising at least one controller to direct the first linear actuator and the second linear actuator in accordance with a multi-stage contact pad procedure. Element 11: the radial force is approximately perpendicular to a longitudinal axis of the tool body.

Element 12: adjusting alignment of the contact pad comprises operating another linear actuator to move the contact pad axially with respect to the tool body. Element 13: adjusting alignment of the contact pad comprises progressing from one stage thickness to another stage thickness until a thickest stage available for use is determined. Element 14: adjusting alignment of the contact pad comprises engaging at least one inclined surface of the contact pad with a raised portion of the tool body. Element 15: the linear actuator in a hydraulic actuator. Element 16: performing an operation while the tool is anchored comprises performing a well intervention operation. Element 17: further comprising adjusting alignment of at least one additional contact pad relative to corresponding linear actuators integrated with the tool body and operating the corresponding linear actuators to apply an outward force to each additional contact pad, where each additional contact pad has multiple stages with different thicknesses. Element 18: further comprising deploying the tool in the downhole environment using a wireline or coiled tubing.

Numerous variations and modifications will become apparent to those skilled in the art once the above disclosure is fully appreciated. It is intended that the following claims be interpreted to embrace all such variations and modifications.

What is claimed is:

1. A downhole tool that comprises:

a tool body, wherein the tool body comprises a raised portion, wherein the raised portion is an extension of the outer profile of the tool body; and an anchoring device integrated with the tool body, wherein the anchoring device comprises:

a contact pad that is at least partially external to the tool body, the contact pad having multiple stages with different thicknesses;

a first linear actuator wherein a portion of the first linear actuator is disposed external to the tool body; and a second linear actuator, wherein a portion of the second linear actuator is disposed within the tool body, wherein the second linear actuator comprises a contact component, wherein at least one seal is disposed between the contact component and the raised portion, wherein the first linear actuator is configured to move the contact pad axially with respect to the tool body to align one of the multiple stages with the second linear actuator, wherein the contact pad passes over the raised portion when changing which of the multiple stages is aligned with the second linear actuator;

wherein the second linear actuator is configured to extend the contact component outwardly from a longitudinal axis of the tool body and apply a radial force to the contact pad; and wherein the second linear actuator is configured to simultaneously move all portions of the contact component radially outward from the longitudinal axis of the tool body.

2. The tool of claim 1, wherein the contact pad has an inclined surface between adjacent stages.

3. The tool of claim 1, wherein the anchoring device further comprises a shaft coupling the first linear actuator with the contact pad.

4. The tool of claim 3, wherein the shaft is rotatably-coupled at opposite ends to the first linear actuator and the contact pad.

5. The tool of claim 3, the anchoring device further comprises a spring between the shaft and the first linear actuator.

6. The tool of claim 1, wherein the second linear actuator comprises a hydraulic actuator.

7. The tool of claim 6, wherein the hydraulic actuator has a hydraulic feedline and piston chamber with a predetermined diameter relationship.

8. The tool of claim 1, further comprising a well intervention component that is activated after the anchoring device anchors the tool against the borehole wall or the tubular.

9. The tool according to claim 1, further comprising a plurality of said anchoring device to anchor the tool at different longitudinal or azimuthal positions against the borehole wall or the tubular.

10. The tool of claim 1, further comprising at least one controller to direct the first linear actuator and the second linear actuator in accordance with a multi-stage contact pad procedure.

11. The tool of claim 1, wherein the radial force is approximately perpendicular to a longitudinal axis of the tool body.

* * * * *